United States Patent [19]

Siwula

[11] Patent Number: 4,478,413

[45] Date of Patent: Oct. 23, 1984

[54] TORSION TYPE EXERCISE DEVICE

[76] Inventor: John T. Siwula, 145 Sanford Dr., Jamestown, N.Y. 14701

[21] Appl. No.: 160,836

[22] Filed: Sep. 3, 1980

[51] Int. Cl.[3] ..... A63B 21/00

[52] U.S. Cl. ..... 272/134; 272/138; 272/140

[58] Field of Search ..... 272/93, 140, 142, 143, 272/145, 144, 134; 108/111, 112; 185/37, 39, 45

[56] References Cited

U.S. PATENT DOCUMENTS 1,983,911 12/1934 Luppert ..... 272/140

3,664,666 5/1972 Lloyd ..... 272/134

*Primary Examiner*—Richard J. Apley

*Assistant Examiner*—William R. Browne

*Attorney, Agent, or Firm*—Christel, Bean & Linihan

[57] ABSTRACT

A torsion type exercise device including three sections hinged to each other in a manner which allows the device to be folded up so that the three sections rest in a position adjacent to each other and to be folded out to allow the said three sections to form a platform upon which exercises can be performed. One of the sections has a handle fastened to it to facilitate transporting the device in the folded condition. One of the sections has fastened to it a strap or device which can be used to fasten an individual's legs or other body parts to the platform during the performance of "sit-ups" or other exercises requiring or facilitated by the fastening of an individual's legs or other body parts to the platform. One of the sections contains an adjustable torsion spring mechanism connected to pulleys, cables, and handles fashioned in a manner to offer an adjustable resistance to an individual's muscular movements as he pulls on the handles. The aforementioned three sections are padded to increase the individual's comfort as he exercises.

5 Claims, 6 Drawing Figures

TORSION TYPE EXERCISE DEVICE

CROSS REFERENCES

No references have been found to relate to an adjustable torsion spring exercise device which can be folded up to facilitate storage and portability or folded out to provide a comfortable platform upon which a variety of exercises can be performed.

DESCRIPTION OF THE PRIOR ART AND SUMMARY OF THE INVENTION

This invention relates to a portable exercise device with a torsion spring mechanism devised to be adjustable so as to provide resistance to the muscular contractions of a wide variety of exercises. Some easily portable exercise devises tend to be somewhat limited as to the number of muscle groups that can be exercised. Barbells, universal gyms, etc., present obvious difficulties in the areas of storage and portability. In contrast, the torsion type exercise device can be folded in such a manner that it would take up approximately the same amount of space as an average-size suitcase and be easily transported. Its adjustable torsion spring mechanism provides a high degree of versatility to the device, allowing an individual to vary the tension throughout his exercise routine and also permitting the device to be used by a wide variety of somatotypes. To operate the device, an individual would unsnap the latches fastening the sections together and unfold the device so as to form a platform. By lying on the padded platform and placing the adjustable strap across his legs in the ankle region, an individual could perform the exercise commonly known as "sit-ups". By lying on the platform with his head resting on the portion of the device containing the torsion spring mechanism, an individual could grasp the handles attached by cables to the torsion spring mechanism and perform the exercise commonly known as the "bench press" or other derivations thereof. Also, by standing on the section of the torsion type exercise device containing the torsion springs and grasping the handles, a person could perform a variety of exercises such as arm curls, presses, squats, etc. The spring mechanism can be adjusted so as to provide a variety of tensions for different exercises.

DETAILED DESCRIPTION OF THE DRAWINGS

Figure 1:
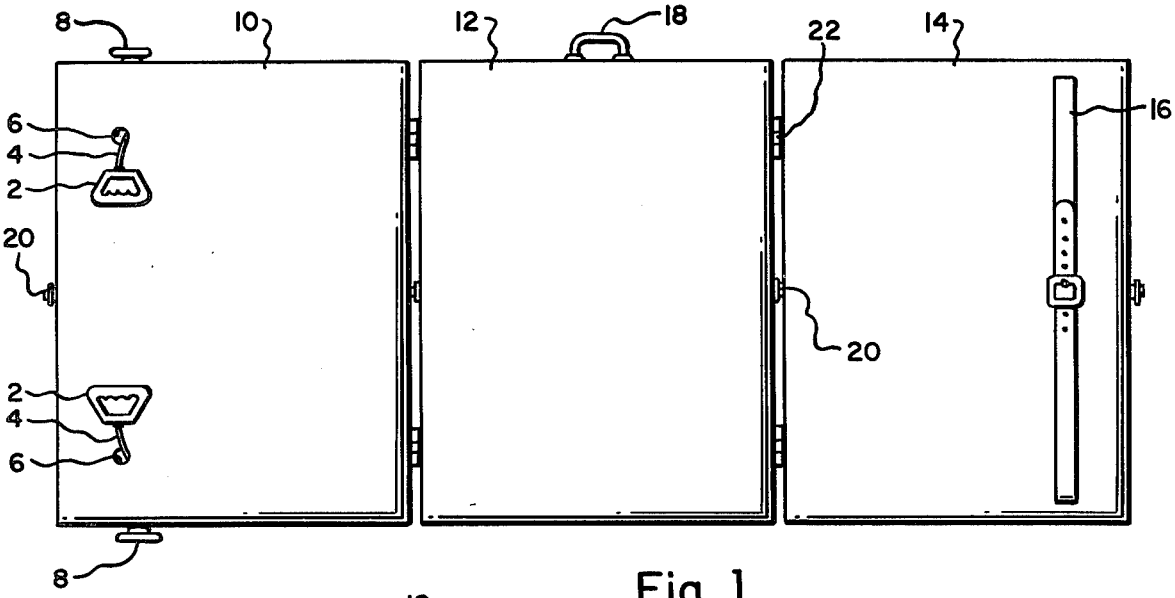
FIG. 1 relates to the torsion type exercise device in an open and folded out position.

FIG. 1 represents the torsion type exercise device opened and folded out to form a platform upon which exercises can be performed. The device consists of three sections 10,12, and 14 which may be padded for comfort. The said sections are attached to each other by hinges 22 which allow the device to be folded up and fastened with latches 20 so as to be stored or transported in a manner analagous to that of a suitcase. One section 10 contains the torsion spring mechanism made adjustable by turning the knobs 8 in a clockwise or counterclockwise direction. Handles 2 are fastened by cables 4 which pass through an opening 6 and wrap around a pulley 32 located inside the device. The middle section 12 is connected to the section 10 housing the adjustable torsion spring mechanism and to the section 14 containing the adjustable strap 16 by hinges 22. Said middle section 12 containing a handle 18 by which the transportation of the torsion type exercise device may be facilitated. Visible also in FIG. 1 are the latches 20 by which the torsion type exercise device is held in a folded condition.

Figure 2:
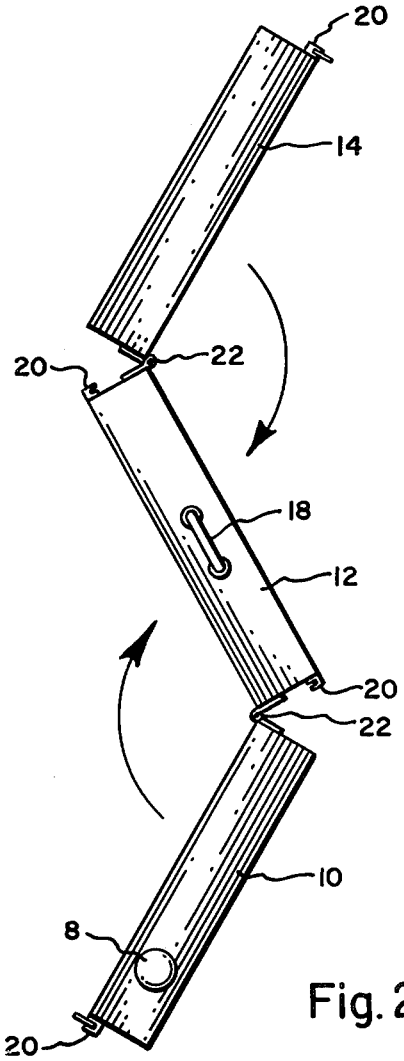
FIG. 2 relates to the method by which the torsion type exercise device folds and latches for storage and transportation.

FIG. 2 is a representation of how the aforementioned sections 10,12,14 of the torsion type exercise device would fold up by the use of hinges 22 and latches 20. Also depicted in FIG. 2 is a knob 8 for adjusting the torsion spring 42 contained within section 10 and the handle 18 for facilitating the storage and handling of the device.

Figure 3:
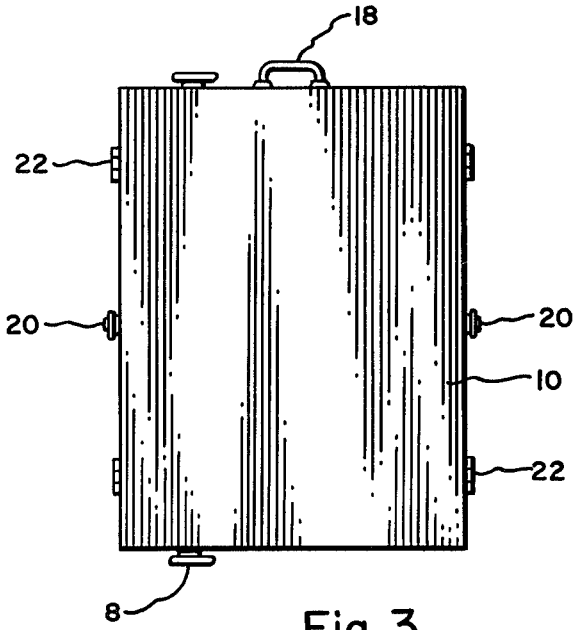
FIG. 3 represents a side view of the torsion type exercise device in folded condition.

FIG. 3 is a side view of the torsion type exercise device in the folded condition depicting the aforementioned hinges 22, latches 20, torsion spring adjustment knob 8, and handle 18.

Figure 4:
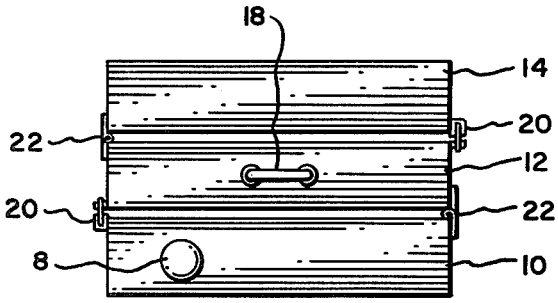
FIG. 4 represents an end view of the torsion type exercise device in folded condition.

FIG. 4 is an end view of the torsion type exercise device featuring the aforementioned sections 10,12,14, hinges 22, latches 20, and handle 18.

Figure 5:
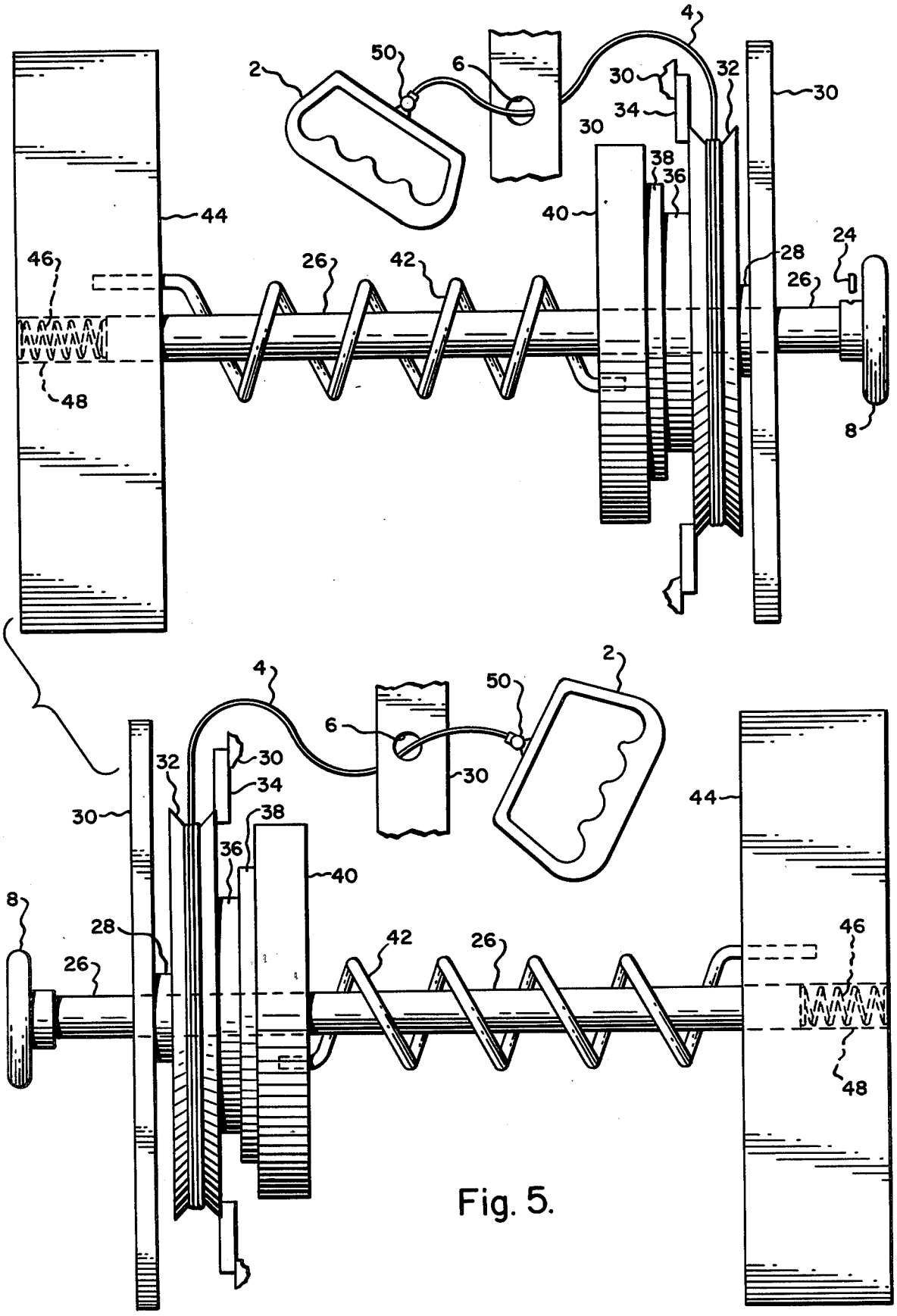
FIG. 5 represents the adjustable torsion spring mechanism.

FIG. 5 depicts the adjustable torsion spring mechanism located within the aforementioned section 10. A knob 8 is fastened to a shaft 26 by means of a pin 24. The shaft 26 passes through the housing of the aforementioned section 10 and through the center of the pulley 32 which is free to rotate on the shaft 26. Said pulley 32 contains holes 54 to receive the pins 52 from the pin plate 36. The shaft 26 passes through the center 56 of the pin plate 36 which is affixed to the shaft 26 and possesses pins 52 which fit into the holes 54 provided in the pulley 32. The pin plate 36 is separated from the pulley 32 by pressing the knob 8 and shaft 26 toward the housing 30. The separation is facilitated by pulley braces 34 which stop the pulley 32 if it happens to move along with the shaft during the separation procedure. The pressure causes the compression spring 46 located within the internal housing 48 to be compressed. When the pressure is released, the compression spring 46 causes the pin plate 36 to engage the pulley 32. This is accomplished when the pins 52 of the pin plate 36 fit into the holes 54 provided in the pulley 32. The shaft 26 also passes through the center of a large washer 38 which acts as a spacer between the pin plate 36 and the larger circular plate 40 which is affixed to the shaft and to which the torsion spring 42 is attached. The other end of the torsion spring 42 is affixed to the housing 44. By pushing the knob 8 inwards, the shaft 26 causes the compression of the spring 46, and the pin plate 36 is forced to separate from the pulley 32. By rotating the knob 8 when the pin plate 36 is separated from the pulley 32, the tension of the torsion spring 42 may be adjusted. When the inward pressure on the knob 8 is released, the compression spring 46 forces the pin plate 36 to engage the pulley 32, thereby transferring the adjusted tension to said pulley 32. The pulley 32 is free to rotate on the shaft 26 but is prevented from losing the induced adjusted tension by being attached to a cable 4 which is attached to a swivel 50 and handle 2. The swivel 50 and handle 2 are located on the exterior of section 10 which contains an opening 6 through which the cable 4 can pass but through which the handle 2 cannot pass. Therefore, the pulley 32 maintains the tension induced on it by the torsion spring 42. The handles 2 rest in depressions in one section 10 facilitating the smooth folding of the device. Also to be mentioned is the washer 28 which keeps the pulley 32 from rubbing the housing 30.

Figure 6:
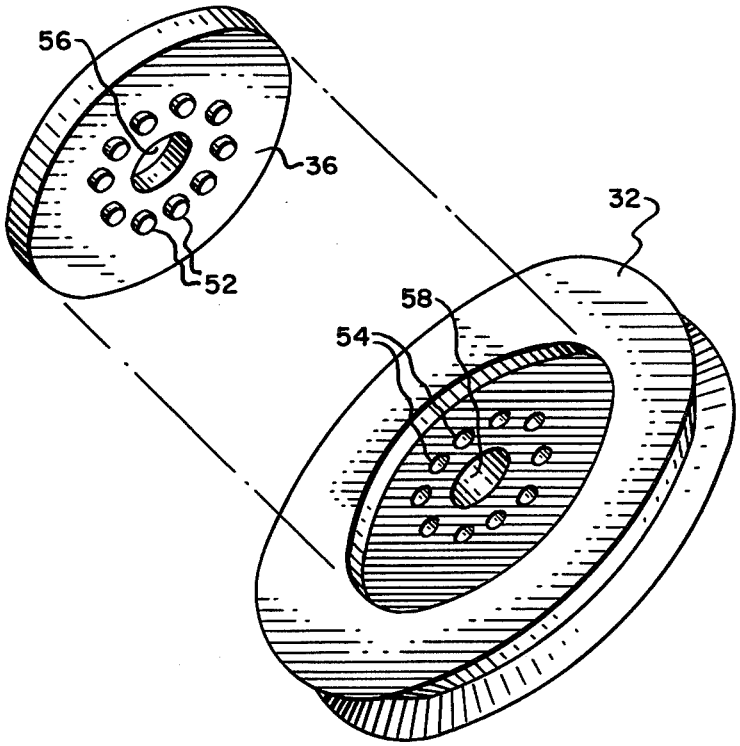
FIG. 6 represents the way in which the pin plate attaches to the pulley.

FIG. 6 shows how the pins 52 of the pin plate 36 fit into holes 54 in the pulley 32. The pin plate 36 has a center hole 56 through which the shaft 26 passes and is affixed. The pulley 32 also has a center hole 58 through which the shaft 26 passes. The pulley 32 is free to rotate on the shaft 26.

I claim:

1. An exercise device comprising:

(a) a support housing;

(b) a shaft having a longitudinal axis and mounted to said support housing for rotation and for a limited amount of longitudinal movement in opposite directions;

(c) a pulley freely rotatable on said shaft;

(d) a torsion spring concentric with said shaft and fixed at one end to said support housing, the torsion of said spring being increased or decreased upon rotation of said spring about the longitudinal axis thereof;

(e) a coupling element located on said shaft axially adjacent said pulley and fixed to said shaft for rotation therewith and for longitudinal movement therewith, said coupling element being fixed to the other end of said torsion spring;

(f) said coupling element and said pulley having cooperating formations thereon for holding said coupling element and pulley in locking engagement upon relative movement of said coupling element and pulley axially toward each other into engagement thereby preventing relative rotation therebetween, said formations being arranged at spaced locations circumferentially about said shaft and in alignment such that said coupling element and pulley are engageable at various selectable relative rotational positions, said pulley and coupling element being disengageable upon relative outward axial movement thereof;

(g) a cable fixed at one end to said pulley wound therearound and having a hand grip at the other end thereof whereby as the user pulls said cable by means of said grip to withdraw said cable said torsion spring provides resistance thereto and when the user releases said grip said torsion spring retracts said cable, said cable having means operatively associated therewith for limiting the extent of movement of said cable and pulley during retraction so as to maintain a predetermined amount of tension applied to said pulley by said torsion spring;

(h) whereby when said shaft is moved a small distance in one longitudinal direction said coupling element and pulley are disengaged and said shaft can be rotated free of said pulley to change the torsion in said spring whereupon longitudinal movement of said shaft in the opposite direction returns said coupling element and pulley into locking engagement and the changed torsion of said spring is applied to said pulley.

2. An exercise device comprising:

(a) a plurality of generally flat sections hinged together so as to be foldable into a closed condition with sections in face-to-face relation to facilitate transportation and storage and which can be opened to position adjacent sections in edge-to-edge relation to define a generally flat platform to support the body of a user performing exercises with said device;

(b) fastening means on one of said sections for holding a part of the user's body such as the legs to facilitate performing exercises;

(c) at least one tension type exercising mechanism carried by another of said sections comprising a hand grip adapted to be grasped by the user, a cable fixed at one end to said grip, and a tension mechanism fixed to said another section and secured to the other end of said cable, said tension mechanism providing resistance to pulling on said hand grip and cable by the user and retracting said cable when said grip is released by the user, said tension mechanism comprising a shaft mounted to said another section at spaced axial locations therealong and movably mounted to said section for a limited amount of longitudinal movement in opposite directions, a pulley rotatable on said shaft, and a torsion spring fixed at one end to said another section and coupled at the other end to said pulley, the torsion of said spring being increased or decreased upon rotation of said spring about the longitudinal axis thereof, said cable being secured to and wound around said pulley; and (d) adjustment means operatively connected to said torsion spring and to said pulley for adjusting the amount of torsion applied by said spring to said pulley, said adjustment means comprising means for mounting said shaft in said another section in a manner permitting reciprocable movement of said shaft along the longitudinal axis thereof, a coupling element fixed to said shaft for rotational and longitudinal movement with said shaft, said coupling element being located on said shaft axially adjacent said pulley, and said coupling element and said pulley having cooperating formations thereon for holding said coupling element and pulley in locking engagement upon relative movement of said coupling element and pulley axially toward each other into engagement thereby preventing relative rotation therebetween, said formations being arranged at spaced locations circumferentially about said shaft and in alignment such that said coupling element and pulley are engageable at various selectable relative rotational positions, said pulley and coupling element being disengaged upon outward axial movement of said coupling element relative to said pulley, whereby upon longitudinal movement of said shaft in one direction said coupling element and pulley are disengaged and said shaft can be rotated free of said pulley to change the torsion in said spring whereupon longitudinal movement of said shaft in the opposite direction returns said coupling element and pulley into locking engagement and the changed torsion of said spring is applied to said pulley.

3. Apparatus according to claim 2, wherein said fastening means and said tension type exercising mechanisms are on the same side of the platform defined by said sections.

4. Apparatus according to claim 2, wherein said another section has a hollow interior region between spaced-apart walls of said section, said tension mechanisms being located within said interior region, one of said walls having an opening therein and said cable extending through said opening to said grip located externally of said section.

5. Apparatus according to claim 2, wherein one end of said shaft extends from said section and is provided with a hand grip thereon whereby longitudinal and rotational movement of said shaft to change the torsion in said spring is performed manually.

* * * * *